US005250958A

United States Patent [19]

Yoshida et al.

[11] Patent Number: 5,250,958

[45] Date of Patent: Oct. 5, 1993

[54] THERMAL HEAD AND MANUFACTURING METHOD THEREOF

[75] Inventors: Akihiko Yoshida, Hirakata; Atsushi Nishino, Neyagawa; Nobuyuki Yoshiike, Ikoma; Yoshihiro Watanabe, Osaka; Yasuhiro Takeuchi, Hirakata, all of Japan

[73] Assignee: Matsushita Electric Industrial Co., Ltd., Osaka, Japan

[21] Appl. No.: 830,457

[22] Filed: Feb. 5, 1992

Related U.S. Application Data

[63] Continuation of Ser. No. 399,551, Aug. 7, 1989, abandoned.

[30] Foreign Application Priority Data

| | | | |
|---|---|---|---|
| Dec. 10, 1987 | [JP] | Japan | 62-312744 |
| Jun. 29, 1988 | [JP] | Japan | 63-161667 |
| Jul. 22, 1988 | [JP] | Japan | 63-184354 |
| Jul. 22, 1988 | [JP] | Japan | 63-184356 |

[51] Int. Cl.[5] ..... B41J 2/325

[52] U.S. Cl. ..... 346/76 PH; 358/307; 358/308; 358/309; 252/514; 252/518; 252/521

[58] Field of Search ..... 252/516, 518, 521; 338/307, 308, 309; 219/539, 541, 542, 543, 553; 346/76 PH

[56] References Cited

U.S. PATENT DOCUMENTS

| | | | |
|---|---|---|---|
| 3,271,193 | 9/1966 | Boykin | 252/514 |
| 3,607,789 | 9/1971 | Murthy et al. | 252/514 |
| 3,639,274 | 1/1972 | Brandt et al. | 252/514 |
| 3,868,334 | 2/1975 | Van Loan | 252/518 |
| 3,899,449 | 8/1975 | Pukaite | 252/518 |
| 4,130,671 | 12/1978 | Nagesh et al. | 252/518 |
| 4,203,025 | 5/1980 | Hitachi | 346/76 PH |
| 4,293,838 | 10/1981 | Wahlers et al. | 252/518 |
| 4,695,504 | 9/1987 | Watanabe et al. | 252/518 |
| 5,021,194 | 6/1991 | Watanabe et al. | 252/518 |

*Primary Examiner*—Joseph W. Hartary
*Assistant Examiner*—Huan Tran
*Attorney, Agent, or Firm*—Wenderoth, Lind & Ponack

[57] ABSTRACT

In a thermal head comprising at least a pair of electrodes (3), (4), (13), (14), resistor layers (2), (12) in contact against both the electrodes (3), (4), (13), (14), basic plates (1), (11) for supporting the electrodes (3), (4), (13), (14) and the resistor layers (2), (12), the resistor layers (2), (12) are composed of the matrix of the glass and the metal and/or oxide of the resistor component element penetrated into the gap of the atomic coupling of the matrix. The resistor layers (2), (12) are made of paste containing the organic compound of the resistor component element, and the organic compound of the glass matrix component element or glass frit. The thermal head is homogeneous in the resistor layer thereof, and gives the recordings of superior quality.

4 Claims, 3 Drawing Sheets

THERMAL HEAD AND MANUFACTURING METHOD THEREOF

This application is a continuation of now abandoned application, Ser. No. 07/399,551, filed Aug. 7, 1989, now abandoned.

BACKGROUND OF THE INVENTION

The present invention relates to a thermal head for use in recording apparatuses such as facsimile, full color printer, word processor and so on, and more particularly, to improvements in a resistor layer which is one of major components of the thermal head, and the manufacturing method thereof.

The thermal head is mainly composed of at least a pair of electrodes, resistor layers in contact with both the electrodes, base plates for supporting the electrodes and the resistor layers on the surfaces thereof, with at least the surfaces thereof being of insulating property, and abrasion-resistant layers formed on the resistor layers. And there are a thin film type and a thick film type depending upon how to manufacture it. The thin film type is formed by the sputtering, evaporation, etc. of an electrode, a resistor layer, an abrasion-resistant layer in vacuum. Also, the thick film type obtains gold electrodes, a resistor layer composed of a glass layer, $RuO_2$ being scattered therein, and an abrasion-resistant layer composed of glass, by the respective printing, heating operations of, for example, paste of a decomposable organic compound of the gold, paste containing $RuO_2$ and glass frit, and paste of borosilicate glass frit, so that the thick film type may provide a thermal head of higher reliability, lower cost than the thin film type.

The thermal head heats the specified region of the resistor layer in contact with both the electrodes through the current flowing between a pair of electrodes so as to heat the specified region of the recording member, for example, a heat sensitive recording paper for giving one dot portion of recording. Accordingly, the important characteristics to be demanded for the thermal head are that the heating of the resistor layer is efficiently transmitted onto the side of the recording paper, and the heating of the resistor layer between the individual electrode pair disposed normally in a line shape is uniform. As the resistances of these resistor layers are unequal, and the respective heating amount is uneven, the concentration of the individual recording dots to be recorded on the recording paper become unequal, thus causing the lines of variable density on the recording to make the recording quality worse. The characteristics are emphasized especially as the thermal head for full color printer use which demands the gradation record. A cause for such uneven record concentration is considered to be the dispersion of the resistance values of the individual resistor dots. In order to reduce the resistance value dispersion of such individual resistor dots, a trimming step, in the thick film method, is adopted. This step applies the overload pulses on the individual dots of the resistor layer, thus making it possible to have the resistance value within $\pm 0.5\%$ of the target. On the other hand, in the thin film type, the resistance value of the individual resistor dot may be provided within $\pm 2.5\%$ by the controlling operation of the conditions of the evaporation and sputtering for obtaining the resistor. But in the head of the thin film system, it is difficult to further improve the dispersion of the present resistance value, and in the head of the thick film system, the present system has problems as described hereinafter. The resistor layer of the thermal head of the present thick film type is formed by the screen-printing, heating of the paste composed of the resistor component $RuO_2$, glass frit, organic binder. But, as the paste is a mixture between $RuO_2$ powder and glass powder, the resistor layer to be produced by the paste is also a mixture of them. And, if $RuO_2$ powder which is small in granular diameter is used, the resistor layer to be produced by the paste is often aggregated or is worse in the dispersion in the glass matrix, so that the powder becomes very large in diameter in the resistor layer obtained. In the result, the current is adapted to flow through the $RuO_2$ powder in contact against each other. Accordingly, in order to obtain a resistor having a uniform resistance value, it is necessary to provide a considerable amount of $RuO_2$ powder. On the other hand, as the preferential change in the resistance value is caused at a portion easy to be trimmed, especially, in a one resistor dot even if the dot resistance value is made constant by the trimming, the heating is to be concentrated in one portion of one dot in the actual recording even when the dot resistance value has reached the target value, so that the normal dot shape is not obtained. The deviation of the current pass in such one resistor dot is due to unequal distribution of the conductive element like the $RuO_2$ in one resistor dot.

As described hereinabove, in the conventional method of forming the resistor layer from a mixture between the $RuO_2$ and the glass powder, it was difficult to obtain the resistor layer uniform in the resistor value.

SUMMARY OF THE INVENTION

Accordingly, an essential object of the present invention is to provide a thermal head which is free from such conventional inconveniences as described hereinabove, and has a resistor layer uniform in the resistance value so as to give recordings superior in quality.

Another important object of the present invention is to provide a method of obtaining a thermal head which gives recordings superior in quality.

In a thermal head having at least a pair of electrodes, resistor layers in contact against both the electrodes, base plates which support the electrodes and the resistor layers on the surfaces thereof, with at least the surfaces thereof being of insulating property, the thermal head of the present invention has the resistor layer composed of the matrix of the glass, and metal and/or oxide of resistor component element existed in the gap of the atomic bond of the matrix. It is to be noted that the thermal head usually has an abrasion-resistant layer covering the resistor layer.

Here, a preferable method of obtaining the resistor layer of the thermal head comprises a step of forming by a printing, a spin coat, a painting method and so on the film of the paste containing the thermally decomposable organic compound of the resistor component element, and the thermally decomposable organic compound of the element for forming the matrix of the glass, and a step of producing a resistor layer composed of the glass matrix, the metal and/or oxide of the resistor component element dispersed in the matrix through the thermally decomposition of the organic compound in the paste by the heating processing.

The paste is preferable to be composed of the organic compounds, and a solvent for dissolving these organic compounds, an organic binder to be dissolved in the solvent. In the paste, the organic compound of the resistor component element is mixed in a molecular level with the organic compound of the element for forming the matrix of the glass, the oxide of the element for forming the matrix of the glass the metal and/or oxide of the resistor component element are formed through the pyrolytic decomposition of them, and the metal and/or the oxide of the latter is taken into the matrix of the glass to be caused by the fusion of the above-described oxide so as to form the resistor layer. In the resistor layer to be produced in this manner, the metal and/or the oxide of the resistor component element is in a condition, where it is put into the gap of the atomic bond of the matrix of the glass in the atomic or molecular level. Accordingly, the resistor layer becomes extremely uniform in the composition, and the amount of the resistor component element becomes less than it was conventionally.

FIG. 1 shows the relationship between the ruthenium element containing percentage of the resistor layer composed of the glass matrix and mainly the oxide of the ruthenium dispersed in the matrix thereof, and the dispersion of the resistance value of the resistor layer. It is to be noted that the axis of ordinate related to the resistance value shows the value of $\sigma/R\times100$. R is an average value of the resistance value, $\sigma$ is a standard deviation value.

In FIG. 1, A is the characteristics of the resistor layer obtained by the method of the present invention, B shows the characteristics of the resistor layer by the conventional method. In the case of the A, the granular diameter of the oxide of ruthenium is 1 or lower μm, while, in the case of the B, the granular diameter thereof is 5 or higher μm.

In the case of the B, when the Ru element containing amount is less than 10% by weight, the dispersion of the resistance value becomes larger suddenly. On the other hand, in the case of the A, if the Ru element containing amount is less, the dispersion of the resistance value is extremely low.

As another method of obtaining the resistor layer, there is a method of using the paste containing the thermally decomposable organic compound of the resistor component element, and the glass frit, instead of the paste. Even in this case, it is better for the paste to contain the solvent to dissolve the organic compound, and the organic binder to be dissolved in the solvent. When the paste is used, the dispersion property of the metal and/or oxide of the resistor component element in the producing resistor layer is inferior to that of the above-described method, but is extremely superior to that of the conventional method. Namely, the organic compound is in contact against the particles of the glass frit in the condition of the liquid in the paste, the metal and/or the oxide to be produced by the pyrolytic decomposition is dispersed in the molecular level onto the glass frit granular surface, so that they are taken into the glass matrix to be formed through the fusion of the glass frit in this condition.

Here, ruthenium is preferable among them, although there are ruthenium, gold, silver, nickel, chromium, tantalum or the like as the resistor component element to be applied to the present invention The ruthenium exists mainly as an oxide in the resistor layer. The resistor layer using the ruthenium is extremely large in the temperature dependence property of the resistance value as shown in FIG. 2*a*. In order to improve it, it is better to jointly use rhodium. By the joint use of the rhodium, the temperature dependence property of the resistance value is improved as shown in FIG. 2*b*. Also, by the addition of the rhodium, the film forming property of the resistor layer is also improved. In the case of the joint use of the ruthenium and the rhodium, the weight ratio is proper to be $0<Rh/Ru<5$.

Then, as the element for forming the matrix of the glass, there are provided boron, silicon for constituting glass borosilicate, and furthermore, lead for constituting glass lead borosilicate, lanthanum for constituting lanthanum series glass, and besides, bismuth and so on.

Also, in addition to the above description, when necessary, zirconium, titanium, vanadium, aluminum, tantalum, zinc and so on may be added.

As the thermally decomposable organic compound of the above-described element, there are alcohlate such as ethyl alcoxide, isopropoxide or the like, fatty acid ester to be represented by hexane acid ester, polycyclic organic compound such as menthol alcohlate, ester or the like, rosin compound such as abietic acid salt or the like, siloxanes, boric acid organic compound and so on.

Although the temperatures for producing the desired metal or oxide through the heating of the paste containing these organic compounds are different depending upon the compounds to be used, the temperature is usually at 500° through 800° C., which is preferable under the atmosphere containing oxygen.

Although the organic compound of the thermally decomposable property was used in the above description, there are a compound, which gives metal and/or oxide through the decomposition by the application of ultraviolet rays, such as ruthenate of naphthoquinone diazo compound having a carboxyl group, a novolak series of phenol resin compound, a compound with lead, silicon or bismuth, and so on.

When these compounds are used, the ultraviolet ray is applied upon the film of the paste for the decomposition operation.

By the present invention, a resistor layer of a uniform film of 0.3 through 3 μm in thickness may be provided. The resistor layer is superior in thermal efficiency during the recording operation, because it is thin, without defects such as air bubbles being hardly provided therein.

It was difficult to obtain a uniform composition of film with the film thickness of 0.3 μm or more in the resistor layer of the conventional thin film type. On the other hand, in the thick film type, it was easy to obtain the stable film with thickness being 0.3 μm or more, but it was difficult to form the uniform film. In this manner, in the conventional art, it was difficult to have the stable film having the thickness in the range of 0.3 μm through 3.0 μm. The present invention can provide a thermal head which is provided with a resistor layer of a uniform, superior film having the thickness of 0.3 through 3 μm unavailable conventionally.

The present invention may provide a thermal head which is superior in recording quality, thermal efficiency.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
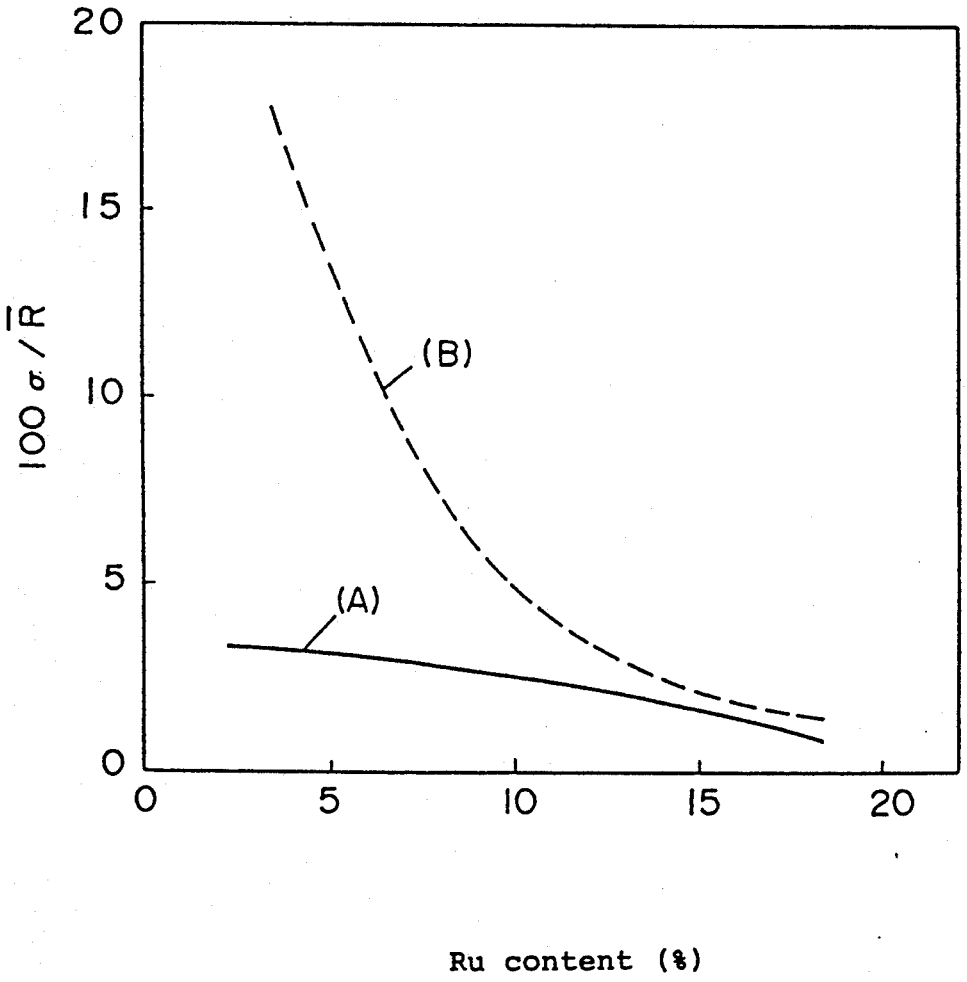
FIG. 1 is a graph showing the relationship between ruthenium containing amount of a resistor layer with the ruthenium as the resistor component and the dispersion of the resistance value of the resistor layer.
Figure 2:
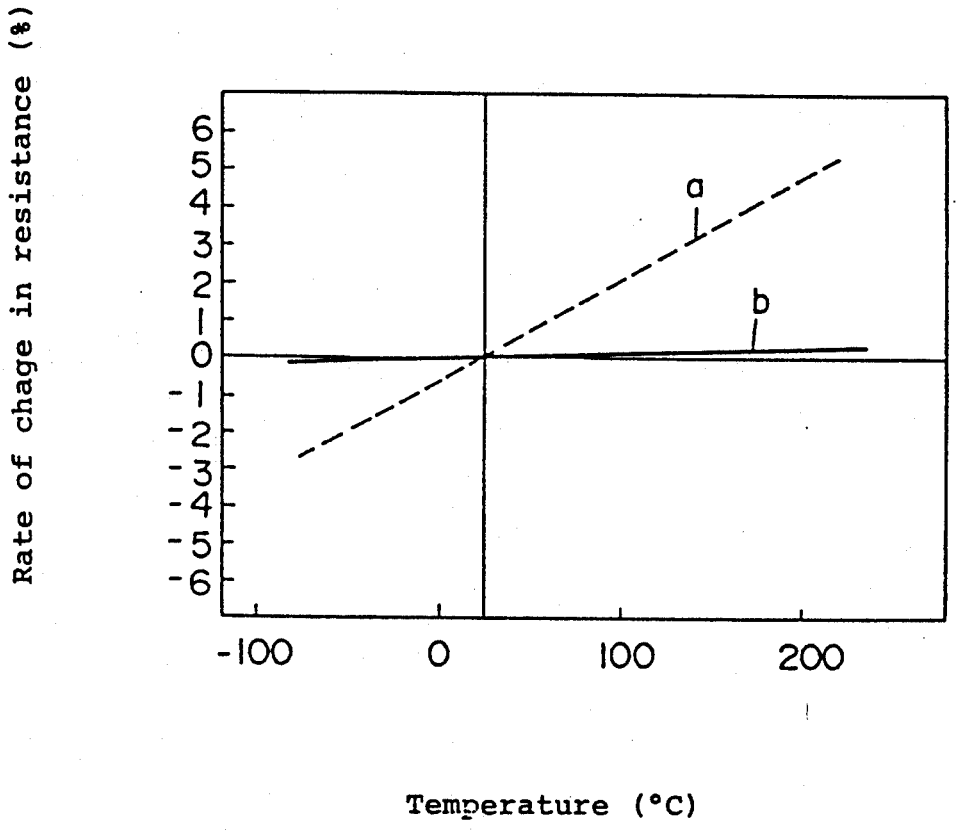
FIG. 2 is a graph showing the temperature dependence of the resistor value of the resistor layer which contains also ruthenium.

Before the description of the present invention proceeds, it is to be noted that like parts are designated by like reference numerals through the accompanying drawings.

Figure 3:
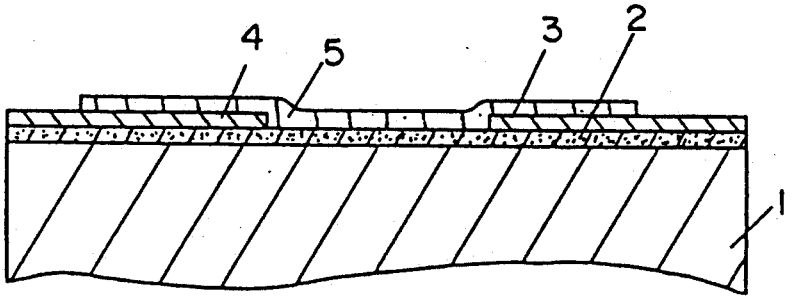
FIG. 3 and FIG. 4 are cross-sectional views each showing the essential portions of the thermal head in accordance with the present invention.

FIG. 3 is a longitudinally sectional view of the essential portions showing the construction example of a thermal head in accordance with the present invention.

1 is a base plate with the surfaces thereof being at least insulated. A steel plate covered with porcelain enamel on the surface thereof, an alumina base plate having a glaze layer on its surface, and so on are used. 2 is a resistor layer formed on the surface thereof. 3, 4 are electrodes formed on the resistor layer 2. Normally one electrode is a common electrode, the other is an individual electrode, with such electrode pair being arranged in the line shape by plurality. 5 is an abrasion-resistant layer covering the surfaces of these electrodes 3, 4 and the resistor layer 2, and comes into contact with the recording paper to transfer the heating of the resistor layer to it so as, also, to prevent the electrodes and the resistor layers from being worn out.

Figure 4:
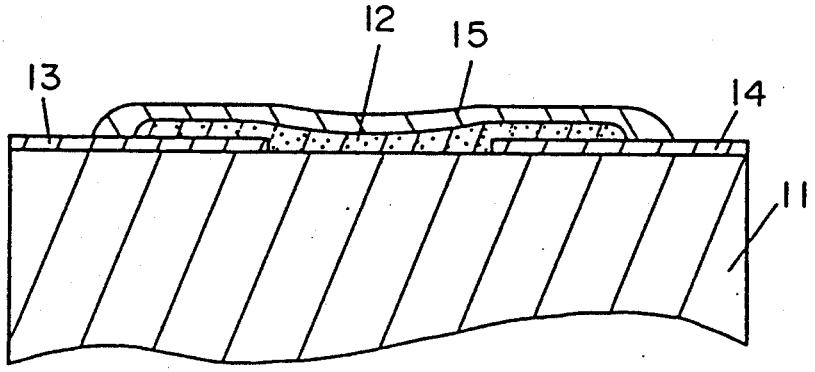

FIG. 4 shows the other construction example of the thermal head. 11 is a basic plate, with the electrodes 13, 14 formed thereon, thereafter the resistor layer 12 and the abrasion-resistant layer 15 being formed The concrete embodiment of the present invention will be described hereinafter.

EMBODIMENT 1

A pair of electrode layers composed of gold are formed on the alumina base plate having the glaze layer of 50 μm in thickness on the surface. The paste for resistor use was screen printed, heated in contact with both the electrodes between the electrode layers to form the resistor layer of 350 μm in width. The paste for resistor use was made of the respective hexane acid salt of Ru, Rh, Si, B, Pb, ethylcellulose and terpineol, and was 50000 c p in viscosity. After the paste printing, it was left as it was and was dried, thereafter it was heated at 800° C. into the resistor layer. The paste of borosilicate glass frit was printed on the resistor layer, heated to form the abrasion-resistant layer. It was to be noted that the mixing ratio of the hexane acid salt in the paste for resistor use was to become 10:4:14:4:68 by the weight ratio of Ru:Rh:Si:B:Pb.

EMBODIMENT 2

Octane acid salt of ruthenium, ethykalcoxide of ruthenium, respective ethylalcohlate of Pb, Si, B were mixed to become 8:70:15:7 by the weight ratio of Ru:Pb:Si:B, the paste with ethylcellulose, terpineol being added thereto was printed, heated into the resistor layer. The other is the same as in the embodiment 1.

EMBODIMENT 3

The same resistor layer as in the embodiment 1 was formed, silicon carbide of 3 μm in thickness was formed into the abrasion-resistant layer by a sputtering method on the resistor layer.

EMBODIMENT 4

Terpineol was further added to the paste of the embodiment 1 to provide 1000 c p in viscosity. The paste was applied with the use of a spinner onto the steel plate having the enamel covered layer of 100 μm in thickness. The revolution number of the spinner was 2000 rpm. After the drying operation, it was heated at 800° C., then the resistor was formed into the given pattern by a photolithography and etching method. Here, the etching liquid was the mixing liquid of sulfuric acid and ammonium fluoride. Then, the paste of gold ethylmerucaptid was printed, heated on the resistor layer to form a gold layer, and continuously formed in the given pattern the gold electrode layer by the photolithography and etching method. The paste composed of the respective hexane acid salt of Si, B, Pb, ethylcellulose, terpineol was printed, burned on it to form the abrasion-resistant layer.

EMBODIMENT 5

The same paste film for resistor use in the embodiment 4 by a roll coater was provided onto the steel plate having the enamel covered layer, heated at 800° C. into the resistor layer. A chrome - copper layer was formed by a sputtering method on the resistor layer, the resistor layer, electrode layer were formed in a given pattern successively by the photolithography and etching of the chrome - copper layer, the photolitho etching of the resistor layer. Thereafter, by the same method as in the embodiment 3, the abrasion-resistant layer was formed.

EMBODIMENT 6

Many individual electrodes were formed in the line shape on the alumina base plate having the glaze layer on the surface and also the common electrode was formed in opposition to the individual electrode. The paste for resistor use was discharged to form the film which comes into contact with both the electrodes, with the use of painting pen having a slit of 350 μm × 10 μm in size between the electrodes. The paste for resistor use here is the same as in the embodiment 1. The paste film was heated at 800° C. after the drying operation into the resistor layer. The paste of the borosilicate glass frit was printed, heated on the resistor layer to form the abrasion-resistant layer.

EMBODIMENT 7

Ethylcellulose and terpineol was added to a mixture of 1:10 in the weight ratio between hexane acid salt and borosilicate glass frit so as to be used as the paste for resistor use. The other was the same as in the embodiment 1.

EMBODIMENT 8

Paste composed of gold ethylmercaptid, diphenyl siloxane, menthol compound of boron, ethylcellulose and terpneol was used as paste for resistor use. The other is the same as in the embodiment 1. However, the mixing ratio of organic compound in the paste was to become 0.15:1 by the weight ratio of gold:(Si+B).

COMPARISON EMBODIMENT 1

A thermal head of a thick film type has an abrasion-proof layer composed of gold electrode, resistor layer, glass formed through the printing, burning of the paste on the alumina base plate having the glaze layer on the surface. Here, the paste which was used to form the resistor was provided by the addition of ethylcellulose and terpineol into the mixture of oxide ruthenium powder 40% by weight of 0.1 μm in average granular diameter, 0.8 μm in maximum granular diameter, and borosilicate glass frit 60% by weight. The printed paste film was heated at 800° C.

COMPARISON EMBODIMENT 2

A thermal head of a thin film type has a resistor layer composed of Ta - Si, an electrode layer of Cr - Cu, and an abrasion-resistant layer composed of silicon carbide formed the alumina base plate having the glaze layer on the surface.

The various characteristics of the thermal heads in the above-described respective embodiments and the comparison embodiments will be shown in the following table.

| | Resistor layer thickness (μm) | Resistor value dispersion 100 × σ/R (%) | Ru content (wt %) | Heat efficiency (watt) | Record quality |
|---|---|---|---|---|---|
| Embodi. 1 | 1 | ±3 | 5 | 0.08 | good |
| 2 | 1 | ±3 | 3 | 0.08 | good |
| 3 | 1 | ±3 | 5 | 0.08 | good |
| 4 | 0.5 | ±2 | 5 | 0.075 | good |
| 5 | 0.5 | ±2 | 5 | 0.075 | good |
| 6 | 1 | ±2 | 5 | 0.075 | good |
| 7 | 5 | ±5 | 20 | 0.1 | good |
| Compari. example 1 | 10 | ±15 | 20 | 0.11 | light, shade lines |
| Compari. example 2 | 0.05 | ±5 | . . . | 0.1 | good |

(notes): In the heat efficiency, electric energies which are required to give the recordings of the reflection concentration 1.0 onto the heat-sensitive recording paper are expressed by values of particular size per dot.

As is clear from the foregoing description, according to the arrangement of the present invention, the resistor layer of the thermal head in accordance with the present invention has homogeneous composition distribution, is thin in film, with thermal capacity being small, so that the thermal efficiency is superior in the recording and the superior quality of recordings are given. Therefore, the present invention may be applied to a full color printer of higher gradation, a facsimile or a word processor and so on.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A thermal head comprising at least a pair of electrodes, resistor layers in contact against both the electrodes, and a base plate with the electrodes and the resistor layers being supported on a surface thereof, at least a surface thereof having insulation properties, each of the resistor layers being composed of a matrix of glass, Ru and/or Ru oxide of a resistor component element existing in a gap of an atomic bonding of the matrix, wherein the ruthenium and/or oxide of ruthenium contained in each of the resistor layers is 10% or lower by weight and which further comprises rhodium in said resistor component element such that the weight ratio of Rh to Ru is $0<Rh/Rh<5$.

2. The thermal head as defined in claim 1 wherein the glass matrix which constitutes each of the resistor layers is a borosilicate series glass or lead borosilicate series glass.

3. The thermal head as defined in claim 1, wherein the glass matrix which forms one of the resistor layers is a lanthanum series glass.

4. In a thermal head comprising at least a pair of electrodes, resistor layers in contact against both the electrodes, and a base plate with the electrodes and the resistor layers being supported on a surface thereof, at least a surface thereof having insulation properties, each of the resistor layers being composed of a matrix of glass, a metal and/or an oxide of a resistor component element existing in a gap of an atomic bonding of the matrix, the improvement thereof, wherein the resistor component element is selected from the group consisting of gold, silver, nickel, chrome and tantalum.

* * * * *